US008231206B2

(12) United States Patent
Otte

(10) Patent No.: US 8,231,206 B2
(45) Date of Patent: Jul. 31, 2012

(54) PRINT HEAD HAVING INTEGRATED DEFLECTING ELECTRODES

(75) Inventor: Frank Otte, Wuerzburg (DE)

(73) Assignee: KBA-Metronic GmbH, Veitshoechheim (DE)

( * ) Notice: Subject to any disclaimer, the term of this patent is extended or adjusted under 35 U.S.C. 154(b) by 0 days.

(21) Appl. No.: 12/998,584

(22) PCT Filed: Oct. 20, 2009

(86) PCT No.: PCT/EP2009/063735

§ 371 (c)(1),
(2), (4) Date: May 5, 2011

(87) PCT Pub. No.: WO2010/052125

PCT Pub. Date: May 14, 2010

(65) Prior Publication Data

US 2011/0221834 A1 Sep. 15, 2011

(30) Foreign Application Priority Data

Nov. 5, 2008 (DE) ..... 10 2008 055 999

(51) Int. Cl.
*B41J 2/02* (2006.01)

(52) U.S. Cl. ..... 347/73

(58) Field of Classification Search ..... 347/73–79, 347/80–83
See application file for complete search history.

(56) References Cited

U.S. PATENT DOCUMENTS

| | | | | |
|---|---|---|---|---|
| 4,743,922 | A | 5/1988 | Regnault et al. | |
| 5,502,473 | A * | 3/1996 | East et al. | 347/73 |
| 6,254,216 | B1 | 7/2001 | Arway et al. | |
| 6,779,879 | B2 * | 8/2004 | Zhan | 347/77 |
| 7,331,657 | B2 * | 2/2008 | Shrivastava et al. | 347/77 |
| 7,992,974 | B2 * | 8/2011 | Matsuda et al. | 347/77 |

FOREIGN PATENT DOCUMENTS

| | | | |
|---|---|---|---|
| WO | 9416898 | A1 | 8/1994 |
| WO | 2008090164 | A2 | 7/2008 |

* cited by examiner

*Primary Examiner* — Kristal Feggins
(74) *Attorney, Agent, or Firm* — Mattingly & Malur, P.C.

(57) ABSTRACT

A print head of a continuous ink jet printer includes a housing that holds the components of the printer head. The housing is made of at least two housing parts that can be separated and that are particularly fastened to each other in an articulated manner. A cavity, that is traversed by the produced ink jet, is arranged between the housing parts. An insert is arranged on each of the housing parts and a cavity that is traversed by the ink jet is formed between the joined inserts. Surface areas of a respective insert that bound the cavity merge seamlessly with each other and form smooth surfaces without gaps, edges, or undercuts.

13 Claims, 2 Drawing Sheets

PRINT HEAD HAVING INTEGRATED DEFLECTING ELECTRODES

CROSS-REFERENCE TO RELATED APPLICATIONS

This application is the U.S. national phase, under 35 U.S.C. 371, of PCT/EP2009/063735, filed Oct. 20, 2009; published as WO 2010/052125 A1 on May 14, 2010, and claiming priority to DE 10 2008 055 999.7, filed Nov. 5, 2008, the disclosures of which are expressly incorporated herein by reference.

FIELD OF THE INVENTION

The invention relates to a system for a continuous inkjet printer comprising a print head having a housing that holds the components of the print head and is made of at least two housing parts that can be separated and that are particularly fastened to one another in an articulated manner, wherein a cavity traversed by a produced ink jet is located between the housing parts.

BACKGROUND OF THE INVENTION

Continuous inkjet printers have been in commercial use for many years for labeling a wide range of products. According to the operating principle of the so-called continuous inkjet printer, ink that will be used in the printing is transported via, pumps out of a storage reservoir to a pressure chamber, under excess pressure, located in the actual print head, with said chamber having a nozzle on its side that faces the object to be imprinted. The nozzle has an opening diameter ranging from 30 μm to 200 μm, for example.

The ink jet is first emitted from the nozzle as a continuous ink jet; however this is not practical for labeling purposes, as the characters produced in this type of labeling are composed of individual dots or individual ink droplets.

To disperse the ink jet into individual, uniform ink droplets, a modulation element is attached to the pressure chamber, which generates pressure fluctuations in the emitted ink jet, causing it to break apart into individual, uniform ink droplets a short time after exiting the nozzle, at a specified distance.

Shortly before the ink droplets are separated from the emitted ink jet, each of the ink droplets is provided with an individual electrical charge, wherein the magnitude of the charge is based upon the desired impact position on the object to be labeled. To guarantee the electrical charge, the electrical conductivity of the ink is low. During the charging process, the ink droplet has not yet been separated from the ink jet emitted from the nozzle of the inkjet printer, and therefore, on the basis of electrostatic induction, free charge carriers in the ink are moved toward or away from the charging electrode, depending on the polarity and intensity of a charging voltage, wherein the ink chamber, and thus the ink reservoir, is held at ground potential, for example. In this case, the charging electrode has no mechanical contact with the ink jet.

If the ink droplet separates from the ink jet while it is within the field region of the charging electrode, the electrical charges that have migrated into the droplets as a result of electrostatic induction remain in the droplet volume, which has an external electric charge even after separation.

For example, if the charging electrode is positively charged, then when the ink jet enters the electrical field of the charging electrode, the negative free charge carriers in the ink migrate into the field, whereas the positively charged free charge carriers in the ink are forced out of the electrical field.

Thus a charge separation takes place at the leading edge of the ink jet, immediately prior to separation of the droplet, and the charge imbalance produced in this manner is maintained in the separating droplet, and the droplet leaves the field region of the charging electrode negatively charged.

Because the ink droplet separates while the charging voltage is acting on the droplet, on the basis of structure and principle, a charge remains on the separated ink droplet, as described, the magnitude of which corresponds to the applied charging voltage, so that when the charging voltage changes, the charge magnitude on each droplet may also be changed.

Frequently, an electrode is also provided immediately downstream of the point of separation of the ink droplet, for detecting the charge actually provided in the droplet, whereby, for example, changes in the charging capacity of the ink and/or other external factors that influence the charge of droplets can be detected, and the charge levels of subsequent drops can be corrected during charging.

It is further known to allow the electrically charged ink droplets, on their initially linear trajectory, to pass into the electrostatic field of a plate capacitor located downstream, wherein they are deflected to a greater or lesser degree from their linear trajectory on the basis of their individual charges, and after leaving the electrostatic field, said droplets continue traveling at a specific angle in relation to their original trajectory, which is a function of their charge. With this system, it is possible to select different positions of impact on a surface to be labeled with individual ink droplets, wherein in this embodiment, this occurs in only one direction of deflection.

To remove individual droplets from the labeling image, or if printing will not be performed, the ink droplets are provided with a specific, fixed charge or remain uncharged, so that after they leave the electrostatic field of the plate capacitor, they strike a collecting tube, from which they are pumped back via a pump system into the ink tank. The ink not used for printing is thus circulated in a circuit, which forms the basis for the term continuous inkjet printer.

One advantage of this is that the usable inks can contain solvents, which evaporate within a very short time after printing on a print substrate, allowing processing of the imprinted objects to continue in a production line immediately after printing.

However, the rapid evaporation of the solvent can lead to problems, particularly inside the print head, if, for example, when the print head is shaken or malfunctions, ink reaches the electrodes or the interior of the print head in an uncontrolled manner, soiling these. Due to the short drying time of the inks, and the adhesivity thereof to the widest range of materials, which is particularly desirable for commercial applications, the interior, and particularly the electrodes located therein, can become so soiled over time that the electrical fields for charging, testing the charge of, and deflecting the ink drops can become altered, thereby impairing the print quality or even the functionality of the printer.

It is therefore necessary to clean the interior of the print head and particularly the electrodes located therein at regular intervals. A disadvantage of the prior art in this regard is that the interior of the print head forms a structured cavity traversed by the ink jet, in which electrodes, with their mounting supports and electrical connectors, are arranged raised and, together with the walls of the cavity, form a multitude of corners, edges and gaps, so that a simple and complete cleaning is complicated and time-consuming, and in some cases, only an incomplete cleaning is possible.

U.S. Pat. No. 4,743,922 A describes a system for a continuous inkjet printer comprising a print head having a housing that holds the components of the print head. The housing is made of at least two housing parts that can be separated and between which a cavity, that is traversed by a produced ink jet, is arranged.

SUMMARY OF THE INVENTION

The problem addressed by the invention is therefore that of configuring the print head for a continuous inkjet printer of the type described in the introductory portion, and more particularly, configuring the interior of the print head, particularly the cavity in the print head that is traversed by the ink jet, such that a simple and complete cleaning, and a resulting restoration of problem-free operation of the print head, can be carried out within the shortest possible time.

The problem is solved by arranging an insert on each of the housing parts, and by forming a cavity traversed by the ink jet between the joined inserts, wherein the surface areas of a respective insert that bound the cavity traversed by the ink jet merge seamlessly into one another, particularly forming smooth surfaces without gaps, edges, or undercuts.

It can also be provided to provide respective recesses in each housing part, and to configure such recesses in such a way that prefabricated, replaceable inserts can be inserted into them, wherein the inserts have no corners or edges, at least in the area of the cavity that faces the ink jet.

Therefore, the cavity traversed by the ink jet is embodied in such a way that only smooth transition areas, particularly having the largest possible radii of curvature, are provided between adjoining surfaces of the inserts. This results in a greatly simplified potential for cleaning, because these surface areas can be accessed more easily once the housing parts have been separated, and can be wiped off, for example. No inaccessible corners and edges remain in the traversed cavity. Preferably, any corners or edges in the cavity can be accessed at least by separating the housing parts, for example, in that when the housing parts are separated, wall regions, which are arranged perpendicular to one another, are also separated from one another, and in that the remaining surfaces of the inserts are embodied as specified according to the invention.

Thus the essential core idea of the invention is that in the interior of the print head, at least in the region of the ink jet, substantially smooth surfaces are present, so that when the interior of the print head becomes soiled with ink, as a result of a malfunction, for example, the ink will reach only easily accessible surfaces that can be cleaned by the simplest means.

In one preferred embodiment of the inserts, it can be provided in the formation of the cavity that the housing parts are embodied as a lower part and an upper part, which are particularly connected to one another in an articulated manner, and can therefore be opened and shut via a hinge-type connection, wherein the surface areas of the insert for the lower part that bound the cavity form a surface having a concave curvature in at least one first, particularly tangential, direction, and the surface areas of the insert for the upper part that bound the cavity form a surface having a concave curvature in at least one second, particularly tangential direction, which is perpendicular to the first. Joining the upper part and lower part produces the cavity, wherein the surfaces that are curved in the two perpendicular directions are situated opposite one another. This configuration is particularly advantageous because the two inserts each have concave surface areas that can be easily cleaned. However, the cavity traversed by the ink jet can also be formed by other embodiments of the inserts.

In any case, an essential aspect of the invention in every embodiment is that the cavity traversed by the ink jet is separated from all the other components of the print head, which are shielded by the inserts, as a result of the positioning of this cavity between the inserts, particularly because the respective inserts, interacting with the housing parts, form respectively closed housings with each of the housing parts, and the ink jet always remains outside of this formed housing.

In a further possible embodiment, a respective insert can be embodied as integrated with the respective housing part, particularly the lower part or upper part. However, it can also be provided that a respective insert is detachably connected to the respective housing part, particularly by means of a latch- and/or snap-type connection, so that replacement can be easily carried out, or the inserts can be removed from the housing for cleaning.

In one preferred embodiment, electrodes, particularly, deflecting electrodes and/or charging electrodes and/or a charge tester electrode, can be at least partially recessed in the surface areas of the inserts that bound the cavity, flush with the surface, particularly without gaps. For this purpose, openings configured to accommodate the electrodes can be arranged in the inserts. These openings can have stepped or chamfered edges, for example, such that electrode plates the height of which corresponds to the step, or a corresponding chamfer, can be inserted into these openings flush with the surface and without gaps.

Thus the electrodes are preferably to be recessed into the inserts in such a way that the surfaces of the electrodes that point toward the cavity of the print head, toward the ink jet traversing the cavity of the print head, form a combined, continuous, flat or curved surface with the inserts.

In another embodiment, electrodes, particularly deflecting electrodes and/or charging electrodes and/or a charge tester electrode, can be arranged under the surface areas of the inserts that bound the cavity, particularly in a region in which the material thickness is reduced. This results in an uninterrupted surface of the inserts, even in the area of the electrodes. The two aforementioned embodiments ensure that any ink can be easily removed from the inserts, because the electrodes do not form any gap and/or edges and/or corners, and instead form only smooth, seamless surfaces.

In general, therefore, the problem is solved in that the cavity of the print head traversed by the ink is formed between preferably replaceable inserts, particularly, made of a suitable material, which cover the necessary electrodes, for example, without significantly impairing the functionality of the print head, or which contain the electrodes, and wherein the inserts have a smooth and seamless shape at least on the side thereof that faces the ink jet, and can be cleaned easily in the shortest possible time.

It can preferably be provided that one electrode of a pair of deflecting electrodes and one electrode of a pair of homopolar charging electrodes is arranged in each of the inserts, and that the opposite pair of electrodes is formed by joining the housing parts. As a result, the ink droplets are also deflected within the separate cavity that is formed between the inserts.

It can further be provided to connect the electrodes located in the inserts to a respective electrical controller via plug-type connections provided in the inserts and in the recesses of the respective upper part or lower part.

It can further be provided that the inserts are made of an electrically non-conducting material, for example, plastic or ceramic or glass or porcelain.

It can further be provided that the inserts are made of a material which is resistant to ink and cleaning agents, preferably wear-resistant material, for example, plastic or ceramic or glass or porcelain.

It can further be provided that the inserts are fabricated by means of an injection molding process. It can further be provided that the inserts are fabricated by means of a sintering method.

It can further be provided to equip at least the side of the inserts that faces the cavity with an anti-stick coating or an ink-repellant coating, for example, with a PTFE coating or a coating which functions on the principle of the lotus effect.

BRIEF DESCRIPTION OF THE DRAWINGS

The prior art and embodiment examples of the invention are illustrated in the figures. These show.

DESCRIPTION OF THE PREFERRED EMBODIMENTS

Figure 1:
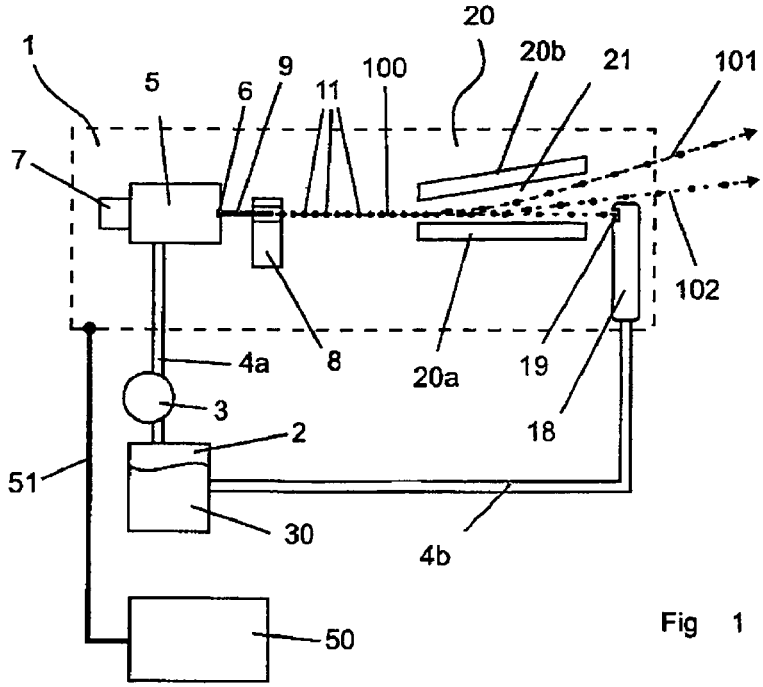
FIG. 1 a schematic illustration of the functioning principle of a continuous inkjet printer FIG. 2 a technical configuration of a print head of a continuous inkjet printer of the known type FIG. 3 a first embodiment of a print head FIG. 4 a second embodiment of a print head with replaceable inserts

FIG. 1 shows a schematic illustration of the functioning principle of a print head for a continuous inkjet printer. The ink 30 is first pumped out of a reservoir 2 by means of a pump 3, via lines 4*a*, into the pressure chamber 5 located in the print head 1, at one end of which chamber a nozzle 6 is located. Via additional modulation elements 7 attached to the pressure chamber, the pressure in the pressure chamber 5 is modulated such that the ink jet 9 emitted via the nozzle 6 is separated, a short distance after being emitted, into individual ink droplets 11 of substantially uniform size.

Shortly before being separated, the individual ink droplets 11 are provided with an individual electrical charge by means of a charging electrode 8, which at least partially surrounds the ink jet, for example, in the shape of a ring/frame/U. Along their trajectory 100, the ink droplets 11 then pass through an electrical field 21, which is formed by the electrodes 20*a* and 20*b* of the plate capacitor 20. On the basis of the magnitude and the polarity of the charges on the ink droplets 11, and the polarity and intensity of the electrical field 21 in the field region of the plate capacitor 20, the individual ink droplets are deflected in different directions in space 101, 102, illustrated by way of example.

The total number of potential deflection angles is based solely on the activation of the charging electrode, and in principle is unlimited. In addition, the individual plates 20*a* and 20*b* of the plate capacitor 20 can be inclined in relation to one another, as shown in FIG. 1. However, it is also possible, without loss of generality, to use plates arranged parallel with one another.

After leaving the field area 21 of the plate capacitor 20, the ink droplets 11 are no longer influenced by electrostatic force, and they maintain their new trajectories 101, 102. The result is a fan-shaped family of trajectories. Ink droplets 11 which have not been charged or have been only lightly charged because they must be removed from the print image, undergo no or only slight deflection in the electrostatic field 21 of the plate capacitor 20, and strike an opening 19 of a collection tube 18 for ink recirculation. The ink collected in this manner is routed via lines 4*b* back to the ink reservoir 2, and is thus returned to the ink circuit.

Figure 2:
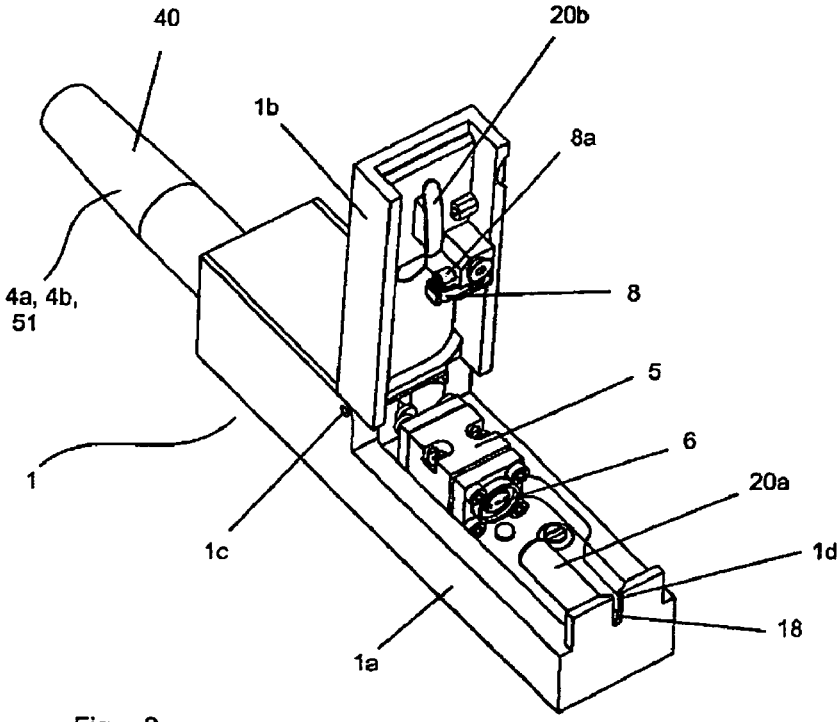

FIG. 2 shows a schematic technical illustration of a print head 1 for a continuous inkjet printer according to the prior art. In this case, the print head 1 comprises essentially a lower part 1*a* and an upper part 1*b*, which are connected to one another, for example, via a hinge 1*c*, allowing the print head 1 to be opened up for cleaning or maintenance, for example.

The print head 1 is further connected to a control and supply unit, not shown here, via a supply line 40, whereby the print head 1 is supplied via the ink supply line 4*a* with the ink required for a labeling process, and the unused ink is transported back to the reservoir 2 via the return line 4*b*.

The respective electrodes and/or the modulator element and corresponding sensor elements are also controlled by means of a corresponding control device 50 via corresponding electrical connections 51, which extend in the supply line 40.

In this case, the lower part 1*a* further comprises the pressure chamber 5 for producing ink droplets 11, for example, and a first electrode 20*a* of a deflecting electrode assembly for deflecting the electrostatically charged ink droplets 11. A second electrode 20*b* of the deflecting electrode assembly is arranged in the upper part 1*b*, for example, in such a way that when the print head is closed, the respective electrodes are opposite and spaced from one another and essentially form a plate capacitor, in the electrostatic field of which electrically charged ink droplets are deflected to a greater or lesser degree out of their trajectory on the basis of their charge.

The different charges are impressed on successive ink droplets, for example, by means of a charging electrode assembly 8 arranged in the upper part, for example, immediately after the ink droplets exit the nozzle 6 of the pressure chamber 5. A further electrode assembly 8*a* can also be provided in the upper part 1*b* of the print head, immediately downstream of the charging electrode assembly 8, for detecting the respective charge states of successive ink droplets, whereby the charge states of successive ink droplets can be adjusted, allowing a constant labeling quality to be achieved.

Ink droplets that do not contribute to the label image and will therefore be charged only lightly or not at all are collected by a collection tube 18 and transported back in the ink circuit as described, whereas ink droplets which contribute to the label image exit the print head 1 through a slit-type opening 1*d* at the end surface of the print head.

Figure 3:
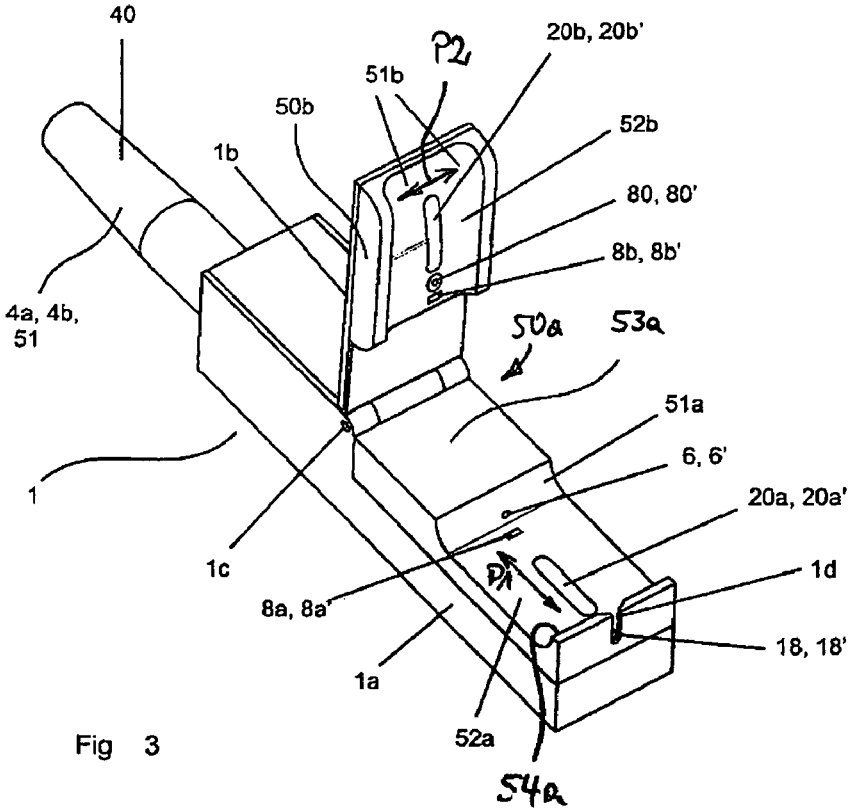

FIG. 3 schematically illustrates a first embodiment of a print head. In this case, the print head 1 has a lower part 1*a* and an upper part 1*b*, which are connected to one another in an articulated manner via a pinned joint 1*c*, allowing the print head to be opened via a hinge-type connection.

In this case, lower part 1*a* and upper part 1*b* have inserts 50*a*, 50*b*, which are permanently connected to, and optionally integral with, the respective lower part 1*a* or upper part 1*b*. The insert 50*a* of the lower part 1*a* has an opening 20*a*' which matches the shape of the deflecting electrode 20*a*, such that the surface of the deflecting electrode that faces the ink jet forms a combined surface with the surface 52*a* of the insert 50*a*, without edges, gaps or undercuts, etc. The electrode 20*a* is therefore integrated flush with the surface of the insert, without edge gaps.

The combined surface can also have curves 51*a*, for example, wherein the respective radii of curvature are chosen such that seamless merge areas between adjoining surface areas are formed, without edges, corners, gaps, or undercuts, etc. The insert 50*a* also has an opening 6' in a surface area which in this example connects two parallel surfaces in different planes, and behind which the nozzle 6 of the pressure chamber 5 is arranged, and through which the ink jet 9 can be emitted.

Here it is clear that the insert 50*a* has surface areas 51*a*, 52*a* and 54*a*, which together form a curved surface with a one-dimensional arching in the direction of arrow P1.

It is further provided to configure the charging electrode 8 in two parts, wherein the lower part 1*a* has an opening 8*a*' for accommodating the first part 8*a* of the charging electrode, and the upper part 1*b* has an opening 8*b*' for accommodating the second part of the charging electrode 8*b*, and wherein the charging electrodes 8*a*, 8*b* are arranged in such a way that when the print head is closed, the electrodes 8*a*, 8*b* are precisely opposite one another and form a combined charging electrode 8, which electrodes 8*a*, 8*b* are controlled similarly via a master controller. These electrodes are also arranged in a single plane, flush with the surrounding surface of the respective insert, without gaps.

The insert 50*a* of the lower part 1*a* further has an opening 18' for accommodating the collection tube 18, and a substantially slit-type opening 1*d* at the end surface of the print head, via which the deflected ink droplets exit the print head 1.

Like the insert 50*a* of the lower part 1*a*, the insert 50*b* of the upper part 1*b* has correspondingly matched openings 20*b*' for accommodating the deflecting electrode 20*b*, and the aforementioned opening 8*b*' for accommodating the second part 8*b* of the charging electrode 8. The configuration is the same as was described for the lower part.

It is further clear here that the insert 50*b* of the upper part has surface areas 51*b* and 52*b*, which together form a surface having a concave arch in the direction of the arrow P2, which is perpendicular to arrow P1.

When joined, the two perpendicular arches in the surfaces of the inserts 50*a* and 50*b* form the cavity which is traversed by the ink jet.

In addition, an opening 80' for accommodating an electrode assembly 80 for detecting the charges on the ink droplets can be provided. The arrangement of the electrodes 20*b*, 8*b*, 80 in the respective openings 20*b*', 8*b*', 80' is such that the respective surfaces thereof that face the interior of the print head join with the surface 52*b* and form a combined surface, wherein the combined surface has no edges, gap, corners, or undercuts.

In a manner similar to that of insert 50*a*, the insert 50*b* can also have shaped areas 51*b*, with which the surface 52*b* forms seamless merge areas with the surfaces of the electrodes, and also, when the print head is closed, forms the desired cavity between the surfaces 52*a* and 52*b* for the emission and deflection of the ink droplets.

In this case, it can be provided to permanently affix the electrodes in the respective openings, for example, by gluing them, and to permanently attach the inserts 50*a*, 50*b* to the lower part 1*a* and the upper part 1*b*, respectively.

Figure 4:
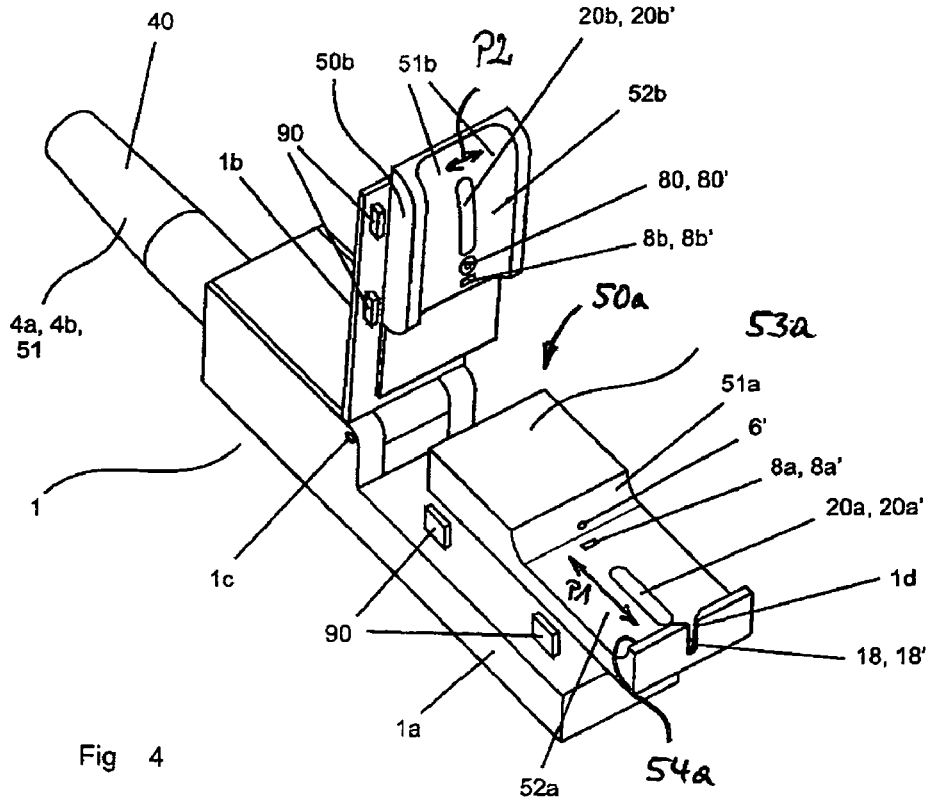

FIG. 4 shows a further embodiment of a print head 1 for a continuous inkjet printer according to the invention, wherein the above-described inserts 50*a*, 50*b* are embodied as replaceable and can therefore be easily exchanged if they should become damaged, for example.

The mechanical connection can be produced, for example, via latch elements 90, which enable an easy replacement of the inserts 50*a*, 50*b*. These latch elements, which project out of a surface of the lower or upper part, engage in corresponding latch recesses in the respective inserts, resulting in a secure but detachable connection.

In this embodiment according to the invention, it is particularly provided to affix the electrodes 20*a*, 20*b*, 8*a*, 8*b*, 80 in their respective inserts 50*a*, 50*b*, for example, by gluing them, or, more particularly, to integrate the electrodes as an injection molded part of the inserts 50*a*, 50*b* during fabrication thereof. In this embodiment, the electrodes are expediently electrically connected to the master controller by means of plug-type connections, not shown here, which are arranged in the lower part 1*a* and the upper part 1*b* and in the corresponding inserts 50*a*, 50*b* in such a way that when the inserts 50*a*, 50*b* are inserted into the proper upper part 1*b* or lower part 1*a*, they become latched into one another, and thereby produce the electrical connection, while at the same time ensuring a necessary electrical insulation against the surrounding parts.

While preferred embodiments of a print head having integrated deflecting electrodes, in accordance with the present invention, have been set forth fully and completely, it will be apparent to one of skill in the art that various changes could be made without departing from the true spirit and scope of the present invention which is accordingly to be limited only by the appended claims.

What is claimed is:

1. A system for a continuous inkjet printer comprising a print head having a housing (1) that holds the components of the print head and is made of at least two housing parts (1*a*, 1*b*) that can be separated and that, more particularly, are fastened to one another in an articulated manner, between which a cavity traversed by a produced ink jet is disposed, characterized in that an insert (50*a*; 50*b*) is arranged on each of the housing parts (1*a*; 1*b*), and in that the cavity traversed by the ink jet is formed between the joined inserts (50*a*; 50*b*), and in that those surface areas (51*a*; 52*a*/51*b*; 52*b*) of each insert (50*a*; 50*b*) that bound the cavity are embodied as merging seamlessly into one another, particularly forming smooth surfaces without gaps, edges, or undercuts.

2. The system according to claim 1, characterized in that the housing parts (1*a*; 1*b*) are formed by a lower part (1*a*) and an upper part (1*b*), which are particularly connected to one another in an articulated manner, wherein the surface areas (51*a*; 52*a*) of the insert (50*a*) for the lower part (1*a*) that bound the cavity form a surface having a concave curvature in at least one first direction, and the surface areas (51*b*; 52*b*) of the insert (50*b*) for the upper part (1*b*) that bound the cavity form a surface having a concave curvature in at least one second direction, which is perpendicular to the first.

3. The system according to claim 1, characterized in that each insert (50*a*; 50*b*) is embodied as integral with the respective housing part (1*a*; 1*b*).

4. The system according to claim 1, characterized in that each insert (50*a*; 50*b*) is detachably connected to the respective housing part (1*a*; 1*b*), particularly by means of a latch- and/or snap-type connection.

5. The print system according to claim 1, characterized in that in the surface areas (51*a*; 52*a*/51*b*; 52*b*) of the inserts (50*a*; 50*b*) that bound the cavity, electrodes (20*a*; 20*b*; 8*a*; 8*b*; 80), particularly deflecting electrodes (20*a*; 20*b*) and/or charging electrodes (8*a*; 8*b*) and/or a charge tester electrode (80), are recessed, flush with the surface, particularly without gaps, for which purpose openings (20*a*'; 20*b*'; 8*a*'; 8*b*'; 80') for accommodating the electrodes (20*a*; 20*b*; 8*a*; 8*b*; 80) are particularly arranged in the inserts (50*a*; 50*b*).

6. The system according to claim 1, characterized in that below the surface areas (51*a*; 52*a*/51*b*; 52*b*) of the inserts (50*a*; 50*b*) that bound the cavity, electrodes (20*a*; 20*b*; 8*a*; 8*b*; 80), particularly deflecting electrodes (20*a*; 20*b*) and/or charging electrodes (8*a*; 8*b*) and/or a charge tester electrode (80), are arranged, particularly in a region of reduced material thickness.

7. The system according to claim 6, characterized in that in each case, one electrode of a pair of deflecting electrodes (20; 20*a*) and one electrode of a pair of homopolar charging electrodes (8*a*; 8*b*) is arranged in each of the inserts (50*a*; 50*b*), and in that opposite pairs of electrodes are formed by joining the housing parts (1*a*; 1*b*).

8. The system according to claim 6, characterized in that the electrodes (20*a*; 20*b*; 8*a*; 8*b*; 80) are connected to electrical leads provided in the lower part and in the upper part via plug-type connections integrated into the inserts (50*a*; 50*b*).

9. The system according to claim 1, characterized in that an insert (50*a*), particularly the insert (50*a*) for the lower part (1*a*), has a high surface (53*a*) that covers the pressure chamber (5), and a low surface (52*a*), located in the direction of ink transport, wherein in a surface (51*a*) that connects these surfaces (53*a*; 52*a*), which is curved and merges seamlessly into the low surface (52*a*), an outlet opening (6') for the ink jet is arranged, said jet extending over the low surface (52*a*).

10. The system according to claim 9, characterized in that the low surface (52*a*) in the direction of ink travel merges, curved, into an upright surface (54*a*), in which an outlet gap (1*d*) and/or a collection opening (18) for the ink jet is located.

11. The system according to claim 1, characterized in that at least the surface areas (51*a*; 52*a*/51*b*; 52*b*; 54*a*) of the inserts (50*a*; 50*b*) that bound the cavity and the surfaces of the electrodes (20*a*; 20*b*; 8*a*; 8*b*; 80) have an anti-stick coating or ink-repellent coating.

12. The system according to claim 1, characterized in that the upper part (1*b*) and the lower part (1*a*) of the print head and the respective inserts (50*a*; 50*b*) each have permanently mounted plug-type connectors which engage with one another to allow a replacement of the respective insert (50*a*; 50*b*) and which produce an electrical connection.

13. The system according to claim 1, characterized in that the cavity traversed by the ink jet is separated from all the other components of the print head by the positioning of said cavity between the inserts (50*a*; 50*b*).

* * * * *